United States Patent [19]

Ostrowsky

[11] 4,369,889

[45] Jan. 25, 1983

[54] TAMPERPROOF CLOSURE

[75] Inventor: Efrem M. Ostrowsky, Highland Park, Ill.

[73] Assignee: Ethyl Products Company, Richmond, Va.

[21] Appl. No.: 271,775

[22] Filed: Jun. 8, 1981

[51] Int. Cl.[3] ..... B65D 41/34

[52] U.S. Cl. ..... 215/246; 215/307

[58] Field of Search ..... 215/246, 252; 156/69, 156/86; 53/488

[56] References Cited

U.S. PATENT DOCUMENTS

| | | | |
|---|---|---|---|
| 3,888,347 | 6/1975 | Kramer | 215/307 X |
| 4,033,472 | 7/1977 | Aichinger | 215/256 |
| 4,206,851 | 6/1980 | Ostrowsky | 215/246 |

FOREIGN PATENT DOCUMENTS

| | | | |
|---|---|---|---|
| WO81/00838 | 4/1981 | PCT Int'l Appl. | 215/246 |
| 1384370 | 2/1975 | United Kingdom . | |
| 1524512 | 9/1978 | United Kingdom | 215/246 |

*Primary Examiner*—Donald F. Norton

*Attorney, Agent, or Firm*—Donald L. Johnson; John F. Sieberth; Edgar E. Spielman, Jr.

[57] ABSTRACT

A thermoplastic closure for fitment to a container for packaging product capable of producing internal container pressure, e.g., carbonated beverages, is disclosed. The closure comprises a top wall and an annular sidewall downwardly depending from the top wall. A closure thread on the inside surface of the sidewall is provided for cooperation with the container neck thread to achieve fitment of the closure to the container. A sealing system adjacent the top wall of the closure provides sealing of the closure to the container. Venting structure is provided on either the closure or the container or both for venting of pressurized gas from the container upon loss of the seal when the closure is rotated to remove it from the container. A heat-shrinkable tamper-indicating means is attached to the lowermost edge of the sidewall of the closure. Application of heat to the tamper-indicating means causes it to shrink towards the container and to a point of interference with a container flange. A heat sink structure, such as an annular bead about the outside surface of the sidewall, is utilized to keep the sidewall at a temperature below that temperature which would normally cause the sidewall to shrink.

7 Claims, 4 Drawing Figures

TAMPERPROOF CLOSURE

BACKGROUND OF THE INVENTION

This invention relates to a tamperproof closure suitable for use in packaging carbonated beverages.

Due to the economy of manufacture and availability of raw material, the utilization of thermoplastic closures in packaging carbonated beverages is becoming more popular. To be commercially acceptable, the closure must have tamperproof qualities. A highly successful tamperproof system for use on thermoplastic closures is the one disclosed in U.S. Pat. No. 4,206,851. This system utilizes a fracturable band which can be heat shrunk into an interfering fit with a container flange. The fracturable band is carried by a plurality of non-fracturable ribs attached to the lowermost end of the closure sidewall. Attempted removal of the closure from the container results in fracture of the band as it attempts to override the container flange. There are other tamperproof systems, such as the ones shown in U.S. Pat. No. 4,033,472 and British Patent Specification 1,384,370, which also utilizes a tamperproof band which needs to be heated so that it can achieve a position of interfering fit with a container flange.

In designing the total package, either the container and/or the closure must be designed to prevent premature release of the closure from the container. This premature release phenomenon is most often experienced as the user turns the closure to begin its removal from the container. As the closure is turned, it moves axially upward thus breaking the seal between the top of the closure and the top of the container. Upon loss of the seal, pressurized gas from the container enters between the sidewall of the closure and the container tending to bulge the closure sidewall outwardly. As the closure of the sidewall bulges outwardly, the closure threads are pulled away from engagement with the container threads and the connection between the container and closure is tenuous at best. If the gas is under sufficient pressure, the closure will be released from the container since the container-closure thread engagement is insufficient to contain the pressurized gas. This release is oftentimes with great force thereby presenting danger to the user.

To obviate the dangers presented by premature release, it has been suggested that a vent groove be cut on the inside sidewall of the closure. See U.S. Pat. No. 3,888,347. By using the vent groove, the pressurized gas is not trapped between the closure sidewall and the container, but rather is allowed to pass harmlessly to the atmosphere through the vent groove. Combining a tamperproof system which utilizes heat application with a venting system, such as the one described above, can present a difficult problem. The problem lies in the fact that application of heat to the tamperproof band cannot be done very precisely and that, oftentimes, heat intended for the band also reaches the lower closure sidewall. Heating of the sidewall can cause it to shrink inwardly and make intimate contact with the container flange or container neck. When this occurs, the function of the venting system is compromised as the shrunken portion of the sidewall which is in contact with the container interferes with gas escapement.

The degree and incidence of shrinkage is increased when the lower portion of the sidewall is thinned out so that it flares outwardly from the container flange. The flare configuration is desirable since it aids in placement of the cap on the container as it goes through the capping line. The flaring is also desirable as it provides a space between the closure sidewall and the container flange. Of course, by thinning out the lower portion of the closure sidewall, this thinned sidewall portion will more likely reach its heat shrinking temperature if it receives stray heat from the source used to apply heat to the tamperproof band.

Therefore, it is an object of this invention to provide a thermoplastic closure having a heat-shrinkable tamperproof band and a pressurized gas venting system which are compatible with each other.

THE INVENTION

This invention relates to a thermoplastic closure having a top wall with an annular, downwardly depending sidewall. Above the inside surface of the annular sidewall is a helical closure thread dimensioned for cooperation with a similar container thread for fitment of the closure to the container. A sealing system is utilized above the closure thread to achieve a gas-tight seal when the closure is fitted to the container. Optionally, there can be provided, as a venting system, at least one vent groove which intersects the closure thread and extends from the bottom of the closure sidewall to a point above the closure thread. The vent groove(s) width and depth will be dependent upon the pressures expected to be encountered as the closure is removed from the container. The lower portion of the inside surface of the closure sidewall is preferably flared slightly outward. Connected to the lowermost edge of the closure sidewall is a fracturable, heat-shrinkable, tamperproof band which is attached to the closure sidewall by means of a plurality of non-fracturable ribs. To give the lower portion of the closure sidewall resistance to achieving a temperature conductive to its shrinkage, there is provided on the outside surface of this sidewall portion an annular bead which operates as a heat sink. Also provided, to prevent contact between the flared inside surface of the closure sidewall and the container, are a plurality of stand-off protuberances positioned about the flared inside surface of the closure sidewall. Preferably, these protuberances will take the form of vertical ribs.

By utilizing the annular bead to provide a large heat sink and the protuberances on the inside wall of the flared portion of the container sidewall, it has been found that the container sidewall will not shrink and/or contact the container due to heat received by it during the heating of the tamperproof band.

These and other features of this invention contributing to satisfaction in use and economy in manufacture will be more fully understood when taken in connection with the following description of preferred embodiments and the accompanying drawings in which identical numerals refer to identical parts and in which.

Figure 1:
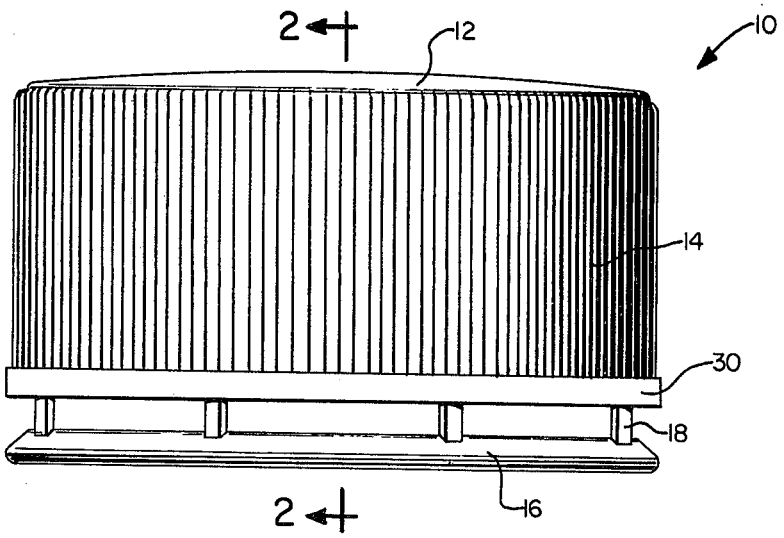
FIG. 1 is a front elevational view of a closure of this invention.
Figure 2:
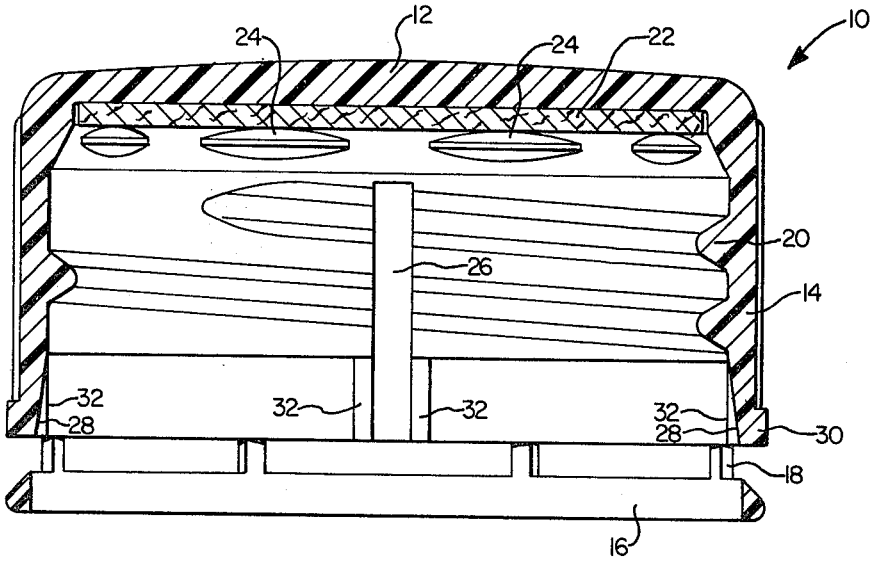
FIG. 2 is a sectional view taken through section line 2—2 of FIG. 1.
Figure 3:
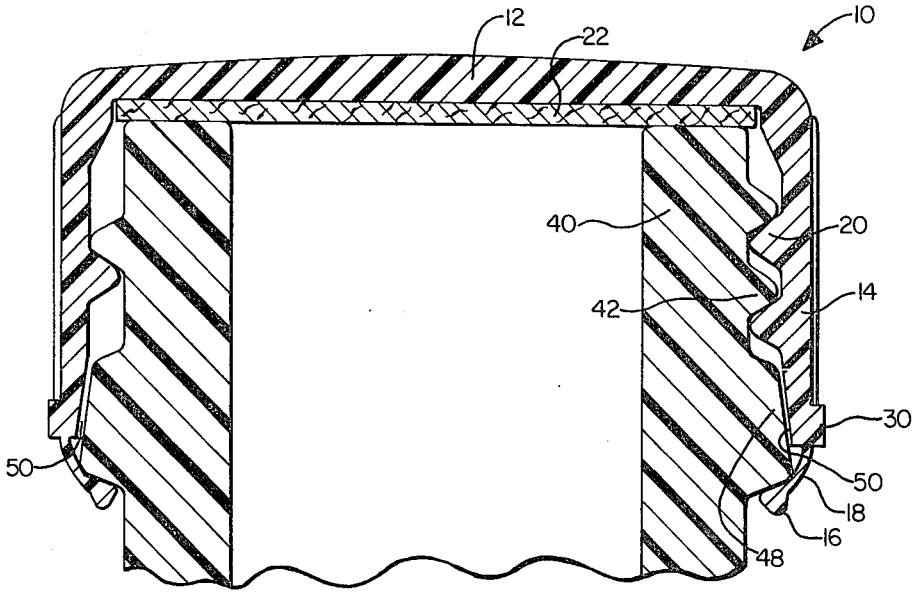
FIG. 3 is a vertical sectional view of the closure shown in FIG. 1 fitted to a container.

Referring now to FIGS. 1–3, the closure of this invention, generally designated by the numeral 10, has a top wall 12 and a downwardly depending annular sidewall 14. Nested against the inside surface of top wall 12 is liner 22. Liner keepers 24 is utilized to hold liner 22 in a position adjacent the inside surface of top wall 12. Liner 22 is utilized to effect a gas-tight seal with the top lip of the container neck. Other sealing systems may be utilized with the closure of this invention. The systems utilized, whether they be liner systems or linerless systems, must fulfill the requirement that they be capable of effecting a gas-tight seal under the pressures expected in the package. About the inside surface of sidewall 14 there is provided a helical thread 20. Helical thread 20 is dimensioned to cooperate with container helical thread 42, shown in FIG. 3, to effect fitment of closure 10 to the container.

Recessed in the inside surface of sidewall 14 is vent groove 26. As can be seen in FIG. 2, vent groove 26 intersects closure thread 20. For the embodiments shown in the drawings, a single vent groove is utilized. However, it is to be understood that more than one vent groove may be used. The width and depth of vent groove 26 should be such that sufficient passageway is provided for the pressurized gas so that it may be vented safely to the atmosphere within a period of time that is shorter than the time necessary for removal of closure 10 from the container by the user. Vent groove 26 is not necessary at all in those cases where the container neck has effective structure to accomplish the venting. See, for example, the container neck channels disclosed in U.S. Pat. No. 4,007,848. In those situations where the thread engagement between the closure and container threads is not intimate throughout the thread's extent, then the gaps in the thread engagement may provide sufficient venting. This situation is often encountered when the thermoplastic closure is utilized on glass containers as the glass container thread is not usually perfectly formed.

The inside surface of sidewall 14, at its lowermost end, is provided with a flared profile when viewed in cross section. Such flaring is beneficial for the reasons stated previously. About the lowermost outside surface of sidewall 14 is provided with annular boss 30. As mentioned previously, annular boss 30 serves the function of providing a heat sink for absorption of "stray heat" from the heat shrinking operation of band 16. Thus, the configuration and size of annular boss 30 is not critical so long as the heat sink function is achieved and thus the lowermost portion of sidewall 14 does not reach a temperature which would cause its shrinkage.

To further discourage contact of the lower inside surface of sidewall 14 with the container, there is additionally provided stand-off protuberances 32. These protuberances prevent any tendency of the lower portion of sidewall 14 to move towards the container. For the embodiment shown, these protuberances are vertical ribs grouped in pairs and spaced each pair every ninety degrees. In fact, it has been found desirable to dimension ribs 32 so that when the closure is fitted to the container, sidewall 14 is slightly deformed outwardly from the container. It is to be understood that other forms of protuberances may be utilized such as beads and the like.

Extending downwardly from the lowermost edge of sidewall 14 are a plurality of non-fracturable ribs 18. These ribs are for carrying heat shrinkable tamper-indicating band 16. Band 16 is provided with at least one weakened portion so that this portion can fracture upon stress applied to the band. This fracture of the band is a clear indication to the user that the closure has been tampered with.

In FIG. 3, closure 10 is shown fitted to a container. As can be seen in this figure, container neck 40 has closure 10 fitted thereto by the cooperation of container threads 42 and closure threads 20. Note that heat shrinkable band 16 has been heat shrunken so that it has moved to a position of interference with container flange 48. As can be appreciated, unscrewing of closure 10 results in upward axial movement of the closure which movement forces the fracture of band 16 as it is not able to follow this axial movement without fracturing due to its interference with container flange 48. Also, it is to be seen from FIG. 3 that the spacing 50 between the lowermost edge of sidewall 14 and container flange 48 has been maintained since no shrinkage of sidewall 14 at its lowermost portion has occurred. Also, as pointed out previously, ribs 32 will act to accomplish this function.

Figure 4:
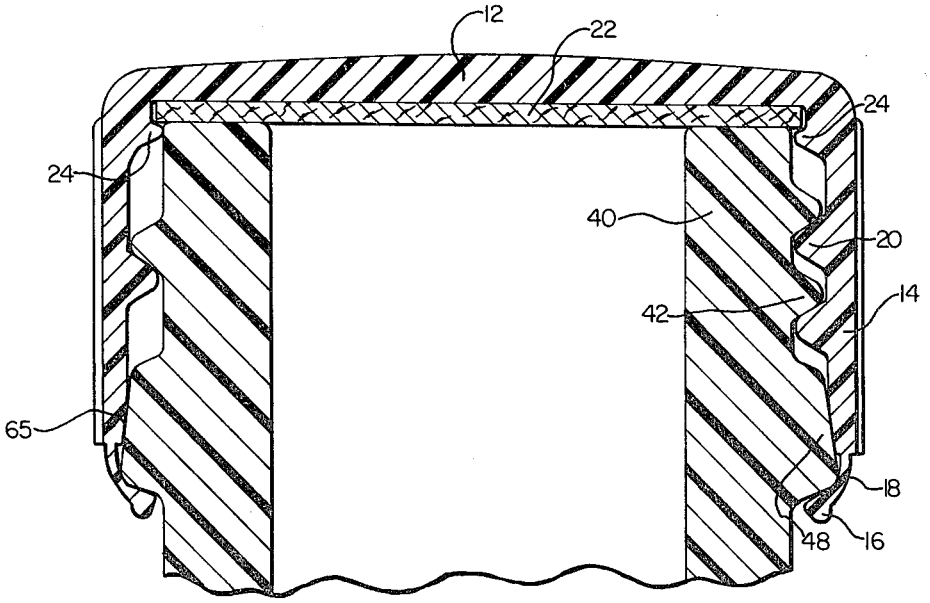
FIG. 4 is a vertical sectional view of a closure not incorporating features of the closure shown in FIG. 1.

In FIG. 4, the results of utilizing closure 10 without annular boss 30 and ribs 32 is depicted. As can be seen, the lowermost portion of sidewall 14 has shrunk inwardly and is in intimate contact with container flange 48. As mentioned previously, this contact often results in restriction of the passage of pressurized gas to the atmosphere so that premature release of the closure occurs.

A particularly useful closure of this invention is one made of polypropylene. However, it is to be understood that other materials may be utilized such as polyethylene terephthalate, polyvinyl chloride, high density polyethylene, and the like. The closure of this invention may be made by any well known injection molding techniques.

Illustrative of the benefits realized when utilizing annular boss 30 is the fact that a polypropylene closure with the features of this invention can be passed through a 52 inch long slotted forced-air heater utilizing 760° air with a passage time of two seconds and a package rotation of $3\frac{1}{4}$ revolutions per pass without shrinkage of the lower portion of sidewall 14. To accomplish this passage through this slotted oven, annular boss 30 had a thickness measured from the inside wall to the outside wall of 0.037 inches. Without annular boss 30, the thickness would normally be 0.028 inches for this portion of sidewall 14.

What is claimed:

1. A thermoplastic closure for fitment into a container, said closure having:

(a) a top wall;

(b) an annular sidewall, downwardly depending from said top wall;

(c) a closure thread about the inside surface of said sidewall;

(d) sealing means above said closure thread for achievement of a gas-tight seal with said container;

(e) gas venting means for venting gas from said container to the atmosphere subsequent to loss of said gas-tight seal when said closure is loosened from its fitment to said container;

(f) heat-shrinkable tamper-indicating means attached to the lowermost end of said closure sidewall; and (g) heat sink means adjacent the lowermost end of said sidewall, said heat sink means being an annular bead extending outwardly from the outer lowermost surface of said sidewall.

2. The closure of claim 1 wherein said gas venting means comprises a vent groove extending from a point above said closure thread to a point adjacent the lowermost edge of said sidewall.

3. The closure of claim 1 wherein said heat-shrinkable tamper-indicating means is a fracturable heat-shrinkable bead attached to the lowermost edge of said sidewall by a plurality of non-fracturable ribs.

4. The closure of claim 1 wherein said closure is polypropylene.

5. The closure of claim 1 wherein the inside surface of the lower portion of said sidewall is flared outwardly by thinning of said lower portion from its uppermost extent to its lowermost extent.

6. The thermoplastic closure of claim 1 additionally having stand-off protuberances about the inside surface of the lower portion of the closure sidewall for aiding in keeping the closure sidewall from making contact with the container.

7. The closure of claim 6 wherein said stand-off protuberances comprise at least one pair of vertically extending ribs.

* * * * *